US009782821B1

(12) United States Patent
Gregory

(10) Patent No.: US 9,782,821 B1
(45) Date of Patent: Oct. 10, 2017

(54) ELECTRIC-HYDRAULIC RIVETER AND LOCKBOLT HAND POWER TOOL

(71) Applicant: Jack T Gregory and Nailia R Gregory Co-Trustees of the 2015 Jack T Gregory & Nailia R Gregory Trust, Sonoma, CA (US)

(72) Inventor: Jack T Gregory, Sonoma, CA (US)

(73) Assignee: Jack T Gregory and Nailia R Gregory, Sonoma, CA (US), Co-Trustees of the 2015 Jack T Gregory and Nailia R Gregory Trust ( * ) Notice: Subject to any disclaimer, the term of this patent is extended or adjusted under 35 U.S.C. 154(b) by 0 days.

(21) Appl. No.: 15/146,282

(22) Filed: May 4, 2016

Related U.S. Application Data

(60) Provisional application No. 62/156,882, filed on May 4, 2015.

(51) Int. Cl.
*B21J 15/20* (2006.01)
*B21J 15/10* (2006.01)
*B21J 15/26* (2006.01)

(52) U.S. Cl.
CPC ..... *B21J 15/20* (2013.01); *B21J 15/105* (2013.01); *B21J 15/26* (2013.01)

(58) Field of Classification Search
CPC ..... B21J 15/20; B21J 15/105; B21J 15/26
USPC ..... 72/453.15
See application file for complete search history.

(56) References Cited

U.S. PATENT DOCUMENTS

| | | | | |
|---|---|---|---|---|
| 4,031,619 | A | 6/1977 | Gregory | |
| 4,248,077 | A | 2/1981 | Gregory | |
| 4,263,801 | A | 4/1981 | Gregory | |
| 4,342,216 | A | 8/1982 | Gregory | |
| 4,489,471 | A | 12/1984 | Gregory | |
| 4,735,048 | A | 4/1988 | Gregory | |
| 6,532,635 | B1 | 3/2003 | Gregory | |
| 6,986,274 | B2 * | 1/2006 | Lefavour | B23D 15/14 60/477 |
| 7,165,439 | B2 * | 1/2007 | Lefavour | B25B 27/10 29/751 |
| 7,421,877 | B2 * | 9/2008 | Frenken | B25B 27/10 72/453.06 |
| 8,056,473 | B2 * | 11/2011 | Frenken | B21D 39/048 100/35 |

(Continued)

*Primary Examiner* — David B Jones
(74) *Attorney, Agent, or Firm* — Gary Hoenig

(57) ABSTRACT

An electrically-hydraulically powered riveter and lockbolt hand power tool is provided, having a battery driven electric motor mechanically powering an offset drive cam through a dual planetary drive gear, the drive cam being in direct mechanical contact with a single stage concentrically delivering longitudinally reciprocating piston pump being in direct hydraulic communication with a work engaging hydraulic cylinder surrounding a centrally fixed and stationary work engaging cylinder piston having a work piece puller shaft, wherein the work engaging hydraulic cylinder is thrust forward around the work piece puller shaft when the tool is activated thereby providing the mechanical motion to activate a user provided riveter nose assembly attachment. A multi-function valve provides essential hydraulic pump features integrated into a single simple component including over pressure relief, isolation of the work engaging cylinder cavity during pumping, and venting when the tool is deactivated.

15 Claims, 5 Drawing Sheets

(56) References Cited

U.S. PATENT DOCUMENTS

| | | | | |
|---|---|---|---|---|
| 8,307,525 | B2 * | 11/2012 | Gregory | B21J 15/205 29/243.521 |
| 8,935,948 | B1 | 1/2015 | Gregory | |
| 2014/0230615 | A1 | 8/2014 | Gregory | |

* cited by examiner

ELECTRIC-HYDRAULIC RIVETER AND LOCKBOLT HAND POWER TOOL

This non-provisional utility patent application, filed in the United States Patent and Trademark Office, claims the benefit of U.S. Provisional Patent Application Ser. No. 62/156,882 filed May 4, 2015 which is hereby incorporated by reference.

FIELD OF INVENTION

The present invention relates to rivet and lockbolt fastener setting hand power tools, and more particularly to such tools which are electrically-hydraulically actuated.

BACKGROUND OF THE INVENTION

Rivets are widely used in the construction of vehicles and equipment. Rivets are also used for many repair applications particularly in the aviation industry. Riveter tools are used for setting riveting multi-piece fasteners such as pop rivets and lockbolts. Each tool is specifically designed for setting a particular rivet design. Setting a rivet can require a significant amount of force, often exceeding 10,000 PSI, to be applied to the fastener, consequently riveter tools for larger rivets are typically heavy, bulky, often requiring an external power source such as a pneumatic supply, and typically incorporating costly complex hydraulic components. Alternatively, manually powered tools often require repetitive pumping action of manual levers so as to achieve the required forces on a work piece for proper installation of the rivet. Rivet setting tools are utilized in many manufacturing and maintenance applications. In maintenance applications, the tools are often used in field locations that are absent power sources or applications and environments presenting awkward access for external electric or pneumatic supply lines. Additionally, manually powered tools are fatiguing for the user. Ideally, a rivet setting tool required for the typical maintenance application such as aircraft and vehicle repair should be lightweight, self powered and provide sufficient load capacity to set rivets and lockbolts. In manufacturing applications, including automotive assembly, the tools are often used along the assembly line where tools tethered to a power source or are unwieldy are impracticable What is needed is an improved hand power tool being self powered, low cost, lightweight, reliable, and adaptable for setting rivets and lockbolts whilst also providing sufficient load force for setting large rivets and lockbolts used in manufacturing and field maintenance operations.

SUMMARY OF THE INVENTION

Accordingly, the present invention is directed to a new electric-hydraulic hand power tool, and, more specifically, a self powered, low cost, simple to manufacture, lightweight, reliable tool having the capability to apply high loads in excess of 10,000 PSI for rivet and lockbolt setting, thereby substantially obviating one or more of the problems due to the limitations and disadvantages of the related art.

In the present invention an electrically-hydraulically powered rivet and lockbolt setting hand power tool is provided, having a battery driven electric motor mechanically connected to an offset drive cam by a planetary drive gear, the drive cam being in direct mechanical contact with a single stage concentrically delivering, longitudinally reciprocating piston pump being in direct hydraulic communication with a work engaging hydraulic cylinder surrounding a centrally fixed and stationary work piece puller shaft, wherein the work engaging hydraulic cylinder is thrust forward around the work piece puller shaft when the tool is activated thereby providing the mechanical motion to activate a provided rivet or lockbolt setting nose assembly attachment.

By providing a concentric integrated spatial relationship of the components of the single stage hydraulic pump portion wherein a pump piston and a pump pressure check valve are longitudinally and concentrically disposed within a pump cylinder disposed in the rear end of a hydraulic piston body and having axial hydraulic fluid delivery, the entire pump assembly may be conveniently manufactured by conventional milling processes from metal stock. The adjacent work engaging cylinder, the tool work engaging piston being the front end of the hydraulic piston body, and work piece puller shaft are also concentrically disposed, consequently the entire hydraulic pump, the various fluid ports and passageways, and the piston for the work engaging cylinder are integrated and are therefore manufactured from a single piece of metal stock by milling. Further advantages of the single stage pump portion include the minimization of complex fluid ports and passageways, valves and other components typically utilized in hydraulic pumps wherein such configurations often require casted components. The reduced component requirement and simplified orientation of the elements significantly reduces manufacturing costs as well as the weight and size of the apparatus thereby fulfilling many objectives of the present invention and overcoming various disadvantages of related prior art tools.

The important objectives of reducing manufacturing costs and reducing complexity are facilitated by implementing a unique, simple, user actuated multi-function valve comprising a valve casing, a load spring, and a valve stem wherein the assembly is spatially arranged to provide functions including sealing the work engaging cylinder during pumping, relieving over pressure within the work engaging cylinder, and venting hydraulic fluid to a reservoir when retracting the tool from a work piece that has been set. The multi-function valve provides all essential hydraulic fluid valving tasks required in a hydraulic tool with only a few components thereby facilitating significantly lower manufacturing costs and high reliability.

A further and important objective of the present invention is to provide an economical high power riveter hand tool constructed from a minimum number of low cost components whilst also providing a durable and reliable tool. In particular, the multi-function valve feature and the in-line pump and work engaging cylinder arrangement reduce the component count of the tool.

An operator uses the riveter and lockbolt tool by positioning the nose of the work piece puller shaft over the stem of a rivet or lockbolt. The operator next activates the tool by depressing the activator trigger. The activated tool pumps hydraulic fluid from the hydraulic fluid reservoir into the work engaging cylinder thrusting the work engaging cylinder forward pushing the collar of a rivet or lockbolt while retaining the stem stationary within the work piece puller shaft. Once the rivet or lockbolt stem shears and is pulled away, the operator releases the activator trigger, deactivating the hydraulic fluid pump and opening pathways to route hydraulic fluid in the work engaging cylinder back to the hydraulic fluid reservoir. With the trigger released, the work engaging cylinder now retracts thereby releasing the rivet or lockbolt stem and the operation is complete.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

In the drawings.

DETAILED DESCRIPTION OF THE INVENTION

Figure 1:
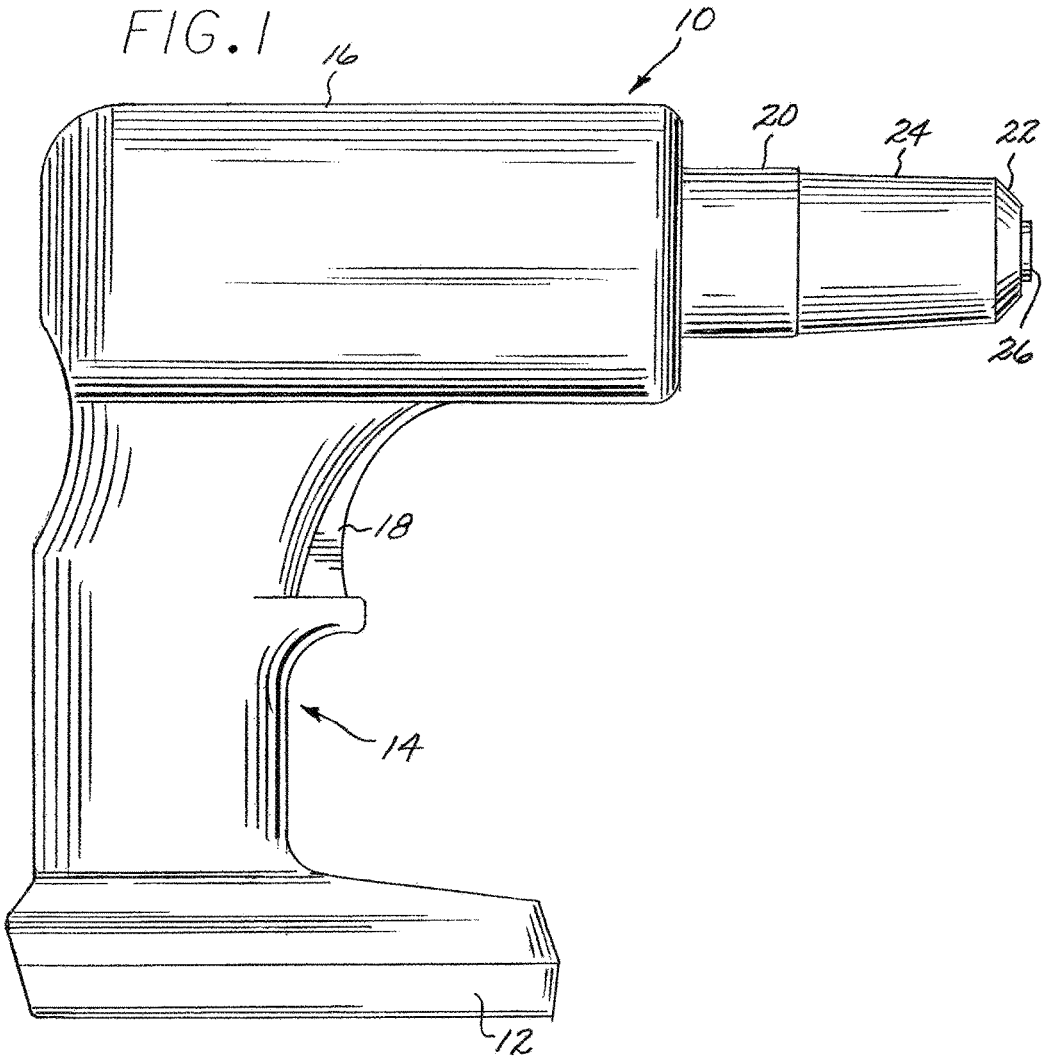
FIG. 1 is a right side elevation view of the electric-hydraulic riveter and lockbolt hand power tool according to the present invention wherein a removable rechargeable battery module forms the bottom of the handle grip and a work piece receiver shaft extends to the front to receive the stem of a rivet or lockbolt.

Although particular embodiments of the invention have been described in detail for purposes of illustration, various modifications may be made without departing from the spirit and scope of the invention. Accordingly, the invention is not to be limited except as by the appended claims. Referring now in greater detail to the various figures of the drawings wherein like reference characters refer to like parts, there is shown in a right side elevation view at 10 in FIG. 1, a first embodiment of a new type of electric-hydraulic activated rivet and lockbolt setting hand power tool.

FIG. 1 illustrates the right side elevation of the electric-hydraulic rivet and lockbolt fastener installation tool embodiment 10 according to the present invention having a design resembling a pistol gripped electric hand drill wherein a battery module 12 is removably attached to the bottom of the handle grip portion 14 of the tool. The tool housing shell portion 16 forms an outer casing securing the components of the tool in spatial relationship with an activator trigger 18 disposed within the handle grip portion 14. The tool is selectively user activated by depressing the activator trigger 18.

Figure 2:
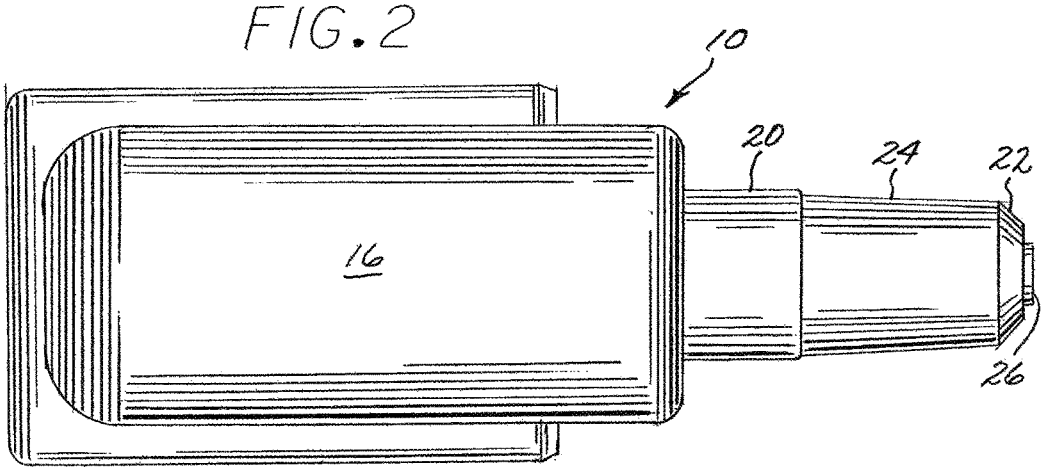
FIG. 2 is a top plan view of the electric-hydraulic riveter and lockbolt setting hand power tool of FIG. 1.
Figures 3, 4:
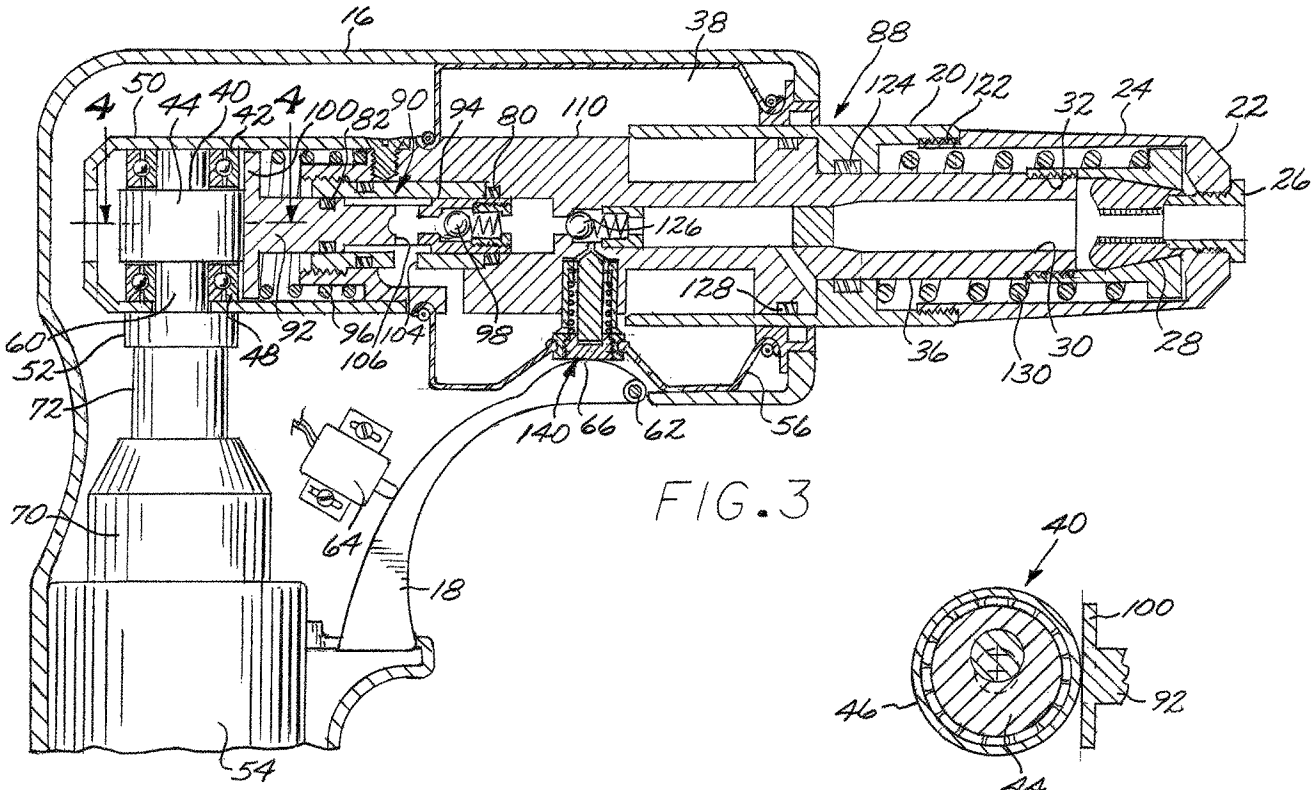
FIG. 3 is a cross section view of the upper portion of the tool of FIG. 1 wherein the essential elements of the tool are illustrated including showing the spatial relationships of the electric drive motor, planetary drive, drive cam, hydraulic activator pump piston in the hydraulic pump cylinder, pump check valve, hydraulic check valves, multi-function valve, work engaging cylinder, centrally fixed work piece puller shaft and work engaging piston, and nose assembly with work piece release mechanism.
FIG. 4 is a cross section view of the drive cam engaging the pump piston, taken on Line 4-4 of FIG. 3, and showing details of the offset of the drive cam relative to the drive shaft.

Referring to FIGS. 1, 2 and 3, details of the spatial relationship of the various components is illustrated. The tool essentially comprises a hydraulic pump and a hydraulic cylinder 88 engaging a provided work piece. Referring to FIG. 3, the main body of the tool is the hydraulic piston body 110 being a continuous element comprising the single stage concentrically delivering longitudinally reciprocating piston pump at the rear and the work piece puller shaft 30 and work engaging piston 36 for the work engaging cylinder 20 being the front portion. A hydraulic piston pump 90 is responsive to an electric drive motor 54 being in direct mechanical communication with a planetary drive 70, rotating a drive cam offset lobe 44 contacting and activating the hydraulic pump 90. The hydraulic pump 90 delivers hydraulic fluid at a pressure and rate to the internal cavity of the hydraulic cylinder 88 comprising a work engaging cylinder 20 surrounding a stationary and centrally disposed work engaging piston 36 thereby forcing the work engaging cylinder 20 outward. It will be appreciated that the hydraulic pump 90 and hydraulic cylinder 88 are aligned longitudinally and concentrically within the tool hydraulic piston body 110 of the tool thereby significantly reducing manufacturing costs.

The hydraulic pump 90 comprises a reciprocating hydraulic activator pump piston 92 disposed in a hydraulic pump cylinder 94, a pump return spring 96 and a pump pressure check valve 98, with the various components arranged to draw hydraulic fluid from a hydraulic fluid reservoir 38, defined by a hydraulic fluid reservoir bladder 56 around the tool piston body 110, on a reverse stroke and to force hydraulic fluid through the pump pressure check valve 98 on a forward stroke. The delivery port of the hydraulic pump is in direct fluid communication with the work engaging cylinder 20. The hydraulic pump 90 is driven by an electrically driven offset cam lobe 44 providing the reciprocating mechanism required for the forward and reverse strokes of the pump piston 92.

Referring further to FIG. 3, being a partial cross section of the tool, the electric motor 54 is positioned within the handle portion 14 with the motor shaft disposed vertically within the housing. The motor shaft rotation speed is reduced by a planetary gear drive 70 mounted to the motor shaft having a preferred reduction ratio of 28:1. The output shaft 72 of the planetary gear drive 70, being upwardly disposed, is in direct mechanical linkage with drive cam 40. The drive cam lower gear housing 52 is pressed onto the planetary gear drive spindle 60. The lower portion of the drive cam 40 is secured in position by the drive cam lower thrust bearing 48 that is secured within the drive cam drive housing 50. The upper portion of the drive cam 40 is secured by the upper drive cam support and upper thrust bearing 42 located at the top of the drive cam drive housing 50.

The electric motor 54, being in direct electrical communication with the battery module 12, and the activator switch 64, receives electrical power from the battery module 12 when a user depresses the activator trigger 18. The depressing the activator trigger 18 in the tool handle portion 14, rotates the activator trigger 18 around trigger pivot 62. The activator switch 64 is contacted by the activator trigger 18 and provides electrical conductivity from the battery module 12 to the electric motor 54 when contacted.

As illustrated in FIG. 4, the central portion of the drive cam 40 comprises an offset cam lobe 44 surrounded by the offset cam lobe bearing 46. The lobe bearing 46 is in direct mechanical contact with the cam follower flange 100 of the pump piston 92 of the single stage hydraulic pump 90 assembly. The drive cam lobe 44 surrounded by drive cam lobe bearing 46 being disposed to rotate off axis of the vertical axis of the drive cam 40 that is mounted concentrically within the drive cam drive housing 50. It will be appreciated that activating the electric motor 54 rotates the drive cam lobe 44, being disposed off axis, around the vertical axis of the assembly thereby yielding a reciprocating motion of the pump piston.

The hydraulic piston body 110 having a central bore receives a pump cylinder sleeve 94 disposed within the central bore and screwed into place and further secured by a set screw. The pump piston reciprocates and slides within the pump cylinder sleeve 94 being biased outwardly by a pump return spring 96 disposed between the pump cam follower flange 100, at the proximate end of the piston 92, and the hydraulic piston body 110. Hydraulic fluid is drawn from the hydraulic fluid reservoir 38 through ports in the hydraulic piston body 110, ports 104 through the wall of the pump cylinder sleeve 94 and through ports 106 in the side of the pump piston 92 wherein there is direct hydraulic fluid communication between the hydraulic fluid reservoir 38 and the pump pressure check valve 98 disposed in a central bore of the pump piston 92 at the distal end. The pump piston forward 80 and rear 82 seals disposed forward and rear of the pump piston ports 106 retain hydraulic fluid within the pump piston central bore. The pump pressure check valve 98 is arranged to allow hydraulic fluid to flow in one direction only from the hydraulic fluid reservoir 38 to the work engaging cylinder 20 internal cavity through work engaging cylinder check valve 126 disposed downstream of the pump. The elements are arranged to pump fluid through the pump pressure check valve 98 from the hydraulic reservoir 38 on the back stroke of the pump piston 92 as shown in FIG. 3. During the forward stroke of the pump piston 92, the pump pressure check valve 98 closes, trapping fluid in front of the pressure check valve 98, forcing fluid downstream as compression builds in front of the forward moving piston, thereby providing a single stage pumping mechanism.

Continuing with FIG. 3, hydraulic fluid forced past the work engaging cylinder check valve 126 fills the internal cavity of the work engaging cylinder 20. The increasing volume of fluid pushes the work engaging cylinder 20 forward, sliding forward along the work engaging piston 36. The work engaging cylinder front 124 and rear 128 seals disposed between the work engaging cylinder 20 and the work engaging piston 36 confine the hydraulic fluid whilst permitting the cavity within the cylinder to expand thereby pushing the work engaging cylinder 20 forward compressing the work engaging cylinder return spring 130.

As further illustrated in FIGS. 1, 2 and 3, the work engaging cylinder 20 is thrust forward and moving outwardly from the tool housing 16 along the work engaging piston 36 when the tool is activated, also pushing the nose outer cone 24 and collar 26 of the riveter nose assembly 22 forward, while the centrally fixed work piece puller shaft 30, forming the distal portion of work engaging piston 36, remains stationary relative to the tool. The outer cone 24 of the riveter nose assembly 22 is screwed onto the nose assembly receiving threads 122 of the work engaging cylinder 20 and the work piece stem grip 28 is screwed onto the work piece stem grip receiving threads 32 of the centrally fixed stationary work piece puller shaft 30 of the tool. During activation of trigger 18, the work engaging cylinder 20 moves forward relative to the stationary work piece shaft 30 wherein the stem of a work piece fastener is held stationary whilst the work engaging cylinder 20 pushes the collar 26 of the riveter nose assembly 22 into the surrounding rivet material thereby providing the required rivet installation motion to pull a rivet or lockbolt stem from a rivet thereby setting the fastener. Releasing the activator trigger 18 permits hydraulic fluid to escape from the work engaging cylinder 20 and being biased to retract by work engaging cylinder return spring 130 disposed between the work engaging cylinder 20 and the work piece stem grip 28 of the work piece puller shaft 30, the work engaging cylinder 20 to retract back into the tool housing 16 and away from the work piece.

Figure 5:
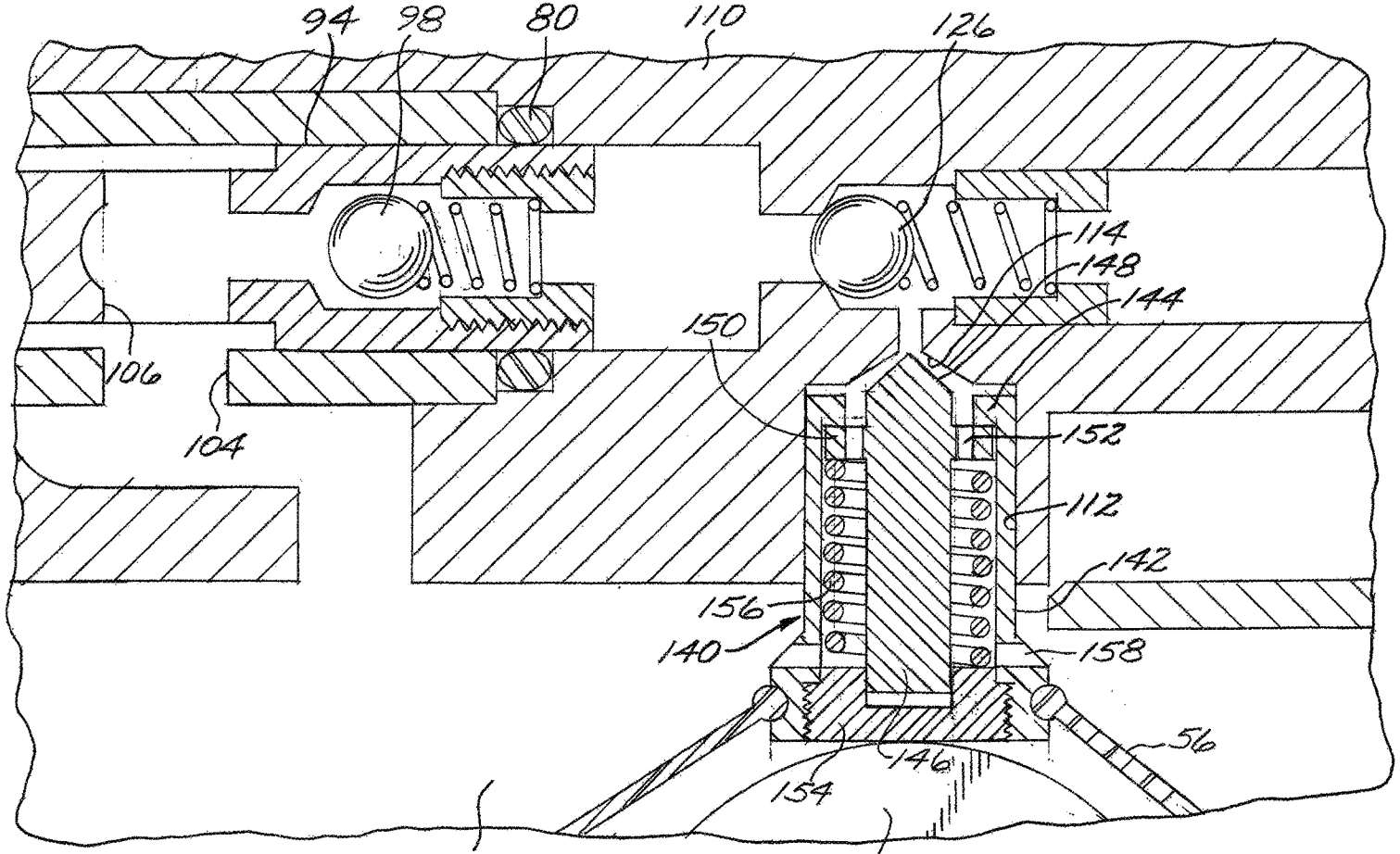
FIG. 5 is an inset view of the cross section view of FIG. 3 showing details of the multi-function valve and the disposition of the valve relative to the pump check valve and the work engaging cylinder check valve wherein the multi-function valve is illustrated in the release position configuration allowing hydraulic fluid to return to the hydraulic fluid reservoir.

In FIG. 5, an inset view taken from FIG. 3, details of the multi-function valve 140 are more clearly illustrated. The multi-function valve 140 provides essential hydraulic pump features integrated into a single simple component including a means for over pressure relief, isolation of the work engaging cylinder cavity during pumping, and venting of the work engaging cylinder 20 internal cavity to the hydraulic fluid reservoir 38 when the tool is deactivated. The unique design of the multi-function valve 140 comprises only four components thereby significantly reducing the number of components required to perform these functions in the typical prior art devices. The valve 140 is slidably disposed within a cylindrically valve bore 112 of the hydraulic piston body perpendicular to the central bores of the hydraulic piston body 110 and having a valve seat 114 formed within the hydraulic piston body 110 having direct hydraulic fluid communication between the valve bore 112 and the work engaging cylinder 20 internal cavity. The multi-function valve 140 comprises a cylindrically shaped valve casing 142 defining the outside of the valve and forming the central valve cylinder. A valve casing collar 144 forms the top of the valve casing 142. A centrally disposed valve stem 146 having a top valve disk 148 portion being conically shaped disk to conform with the conical shape of the valve seat 114 in the hydraulic piston body 110. The valve stem 146 has a cylindrical collar 150 portion near the top of the valve stem 146 having a diameter sufficient to interfere with the valve casing collar 144 wherein the stem collar 150 retains the valve stem 146 within the valve casing. The valve stem collar 150 further has vent ports 152 to permit hydraulic fluid to flow from the top of the multi-function valve 140 into the central bore of the valve casing 142. A retainer plug 154 is screw fit into the bottom of the valve casing 142 with the multi-function valve spring 156 disposed between the plug 154 and the bottom of the stem collar 150. Further bottom vent ports 158 provide hydraulic fluid communication between the central valve cylinder and the hydraulic fluid reservoir 38. Note that the hydraulic fluid reservoir bladder 58 is fixed near the bottom of the multi-function valve 140 thereby assuring that the vent ports 158 provide a flow path directly into the hydraulic fluid reservoir 38.

The multi-function valve 140 is pre-assembled with the valve spring 156 having a spring constant selected for the desired over pressure relief pressure value desired. The multi-function valve 140 is slid into the valve bore 112 in the hydraulic piston body 110 wherein there is a close tolerance fit between the hydraulic piston body 110 and the outside of the valve casing 142. The tolerance of the fit must allow the valve casing to slide whilst also providing a hydraulic fluid seal. The bottom of the multi-function valve contacts the activator trigger lobe 66. Depressing the activator trigger 18 pivots the trigger around trigger pivot 62, leveraging the trigger lobe 66 upwards sliding the multi-function valve 140 further into the hydraulic piston body 110. With the multi-function valve 140 slid into the valve bore 112, the disk 148 of the valve stem 146 contacts the valve seat 142 whilst the valve spring 156 is compressed thereby providing a preselected force of the valve disk against the valve seat 114. Hydraulic fluid is now retained within the cavity of the work engaging cylinder 20. As the actuator trigger 18 also activates the hydraulic pump, the cavity of the work engaging cylinder 20 now expands thereby pushing the work engaging cylinder 20 outwards from the tool.

Note the rest configuration of the multi-function valve 140 in FIG. 5 wherein the actuator trigger lobe 66 position is responsive to the actuator trigger 18 being in the rest position. The valve casing 142 is now shown slid out incrementally from the tool hydraulic piston body valve bore 112 wherein the valve spring 156, pressing against the stem collar 150, presses the stem collar 150 fully against the collar 144 of the valve casing 142 thereby restricting the valve stem 146 from extending further upward. The valve disk 148 is now lifted from the valve seat 114 and hydraulic fluid is free to flow from the interior cavity of the work engaging cylinder 20, through the stem collar vent ports 152, through the lower casing vent ports 158, and back to the reservoir 38.

Figures 6, 8:
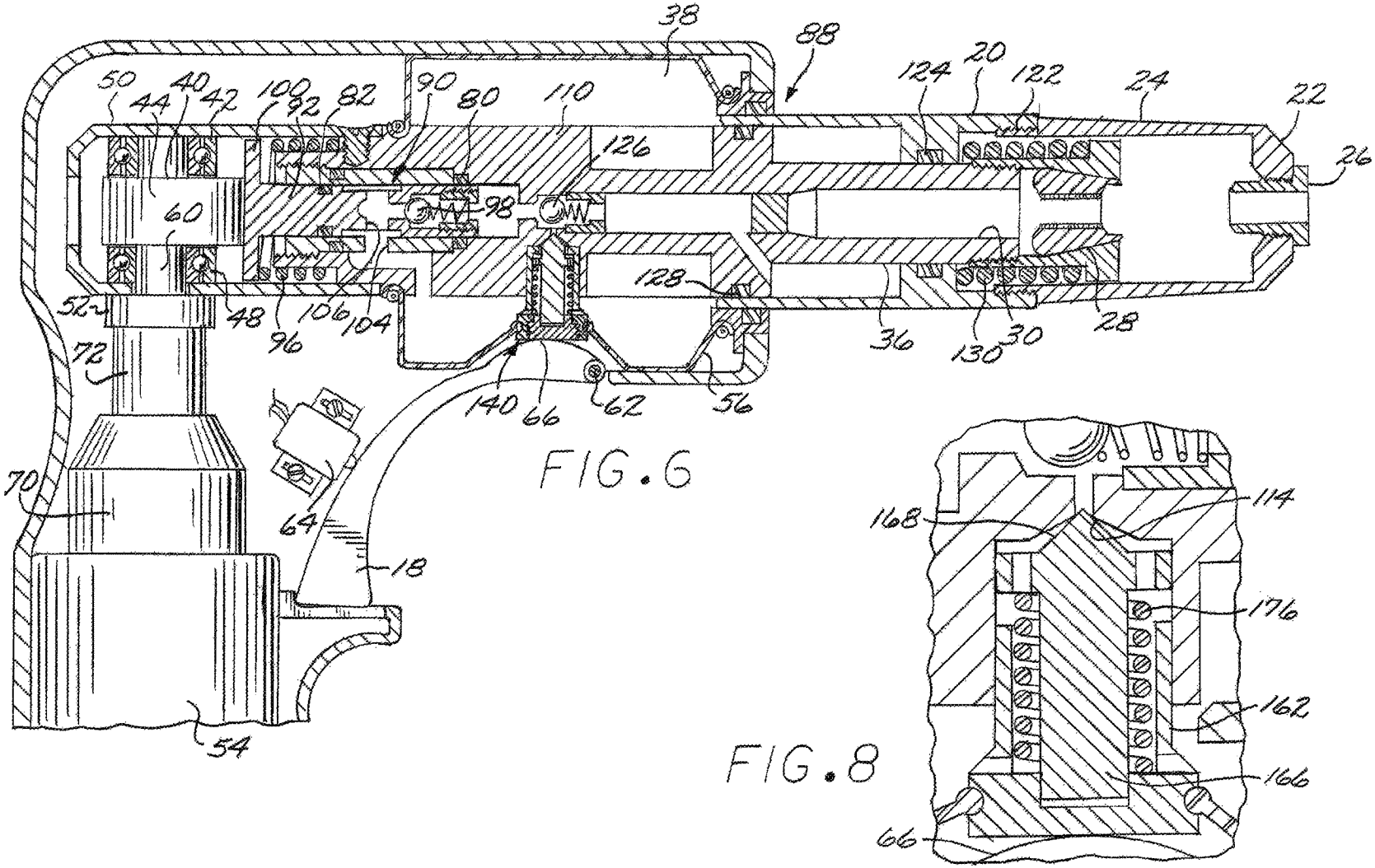
FIG. 6 is a cross section view similar to FIG. 3 illustrating the various tool components disposed in the tool activated mode with the activator trigger depressed, the pump piston shown pressed forward with the pump check valve closed forcing hydraulic fluid downstream, the stem of the multi-function valve engaging the valve seat and the work engaging cylinder check valve forced open by hydraulic fluid from the pump to flow into the work engaging cylinder.
FIG. 8 is an inset view of the cross section view similar to FIG. 7 showing details of an alternate embodiment of the multi-function valve configuration whilst the work engaging cylinder is pressurized during a forward pump stroke. The alternate embodiment includes a modified valve casing.
Figure 7:
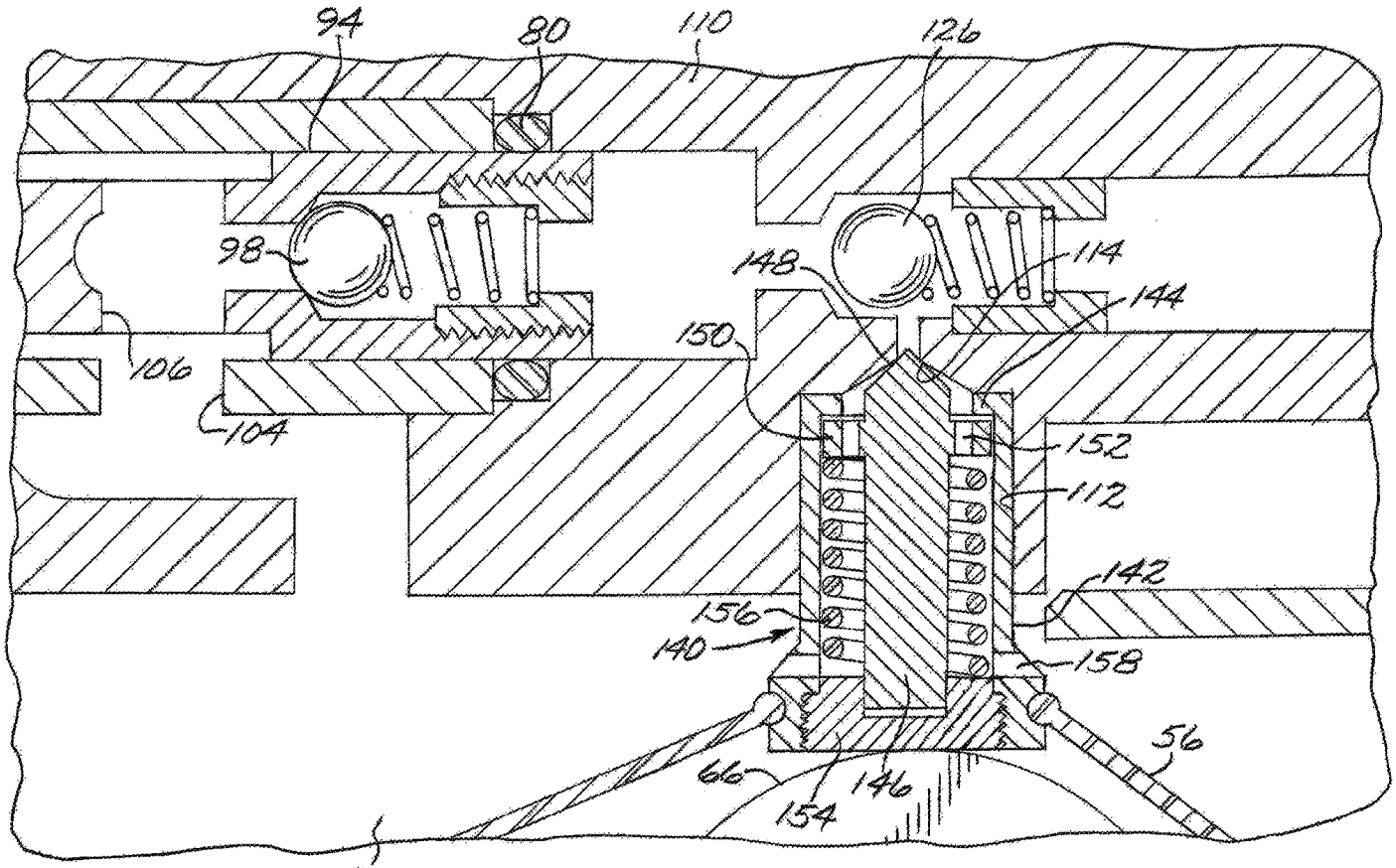
FIG. 7 is an inset view of the cross section view of FIG. 6 showing details of the multi-function valve configuration whilst the work engaging cylinder is pressurized during a forward pump stroke.

Referring now to FIGS. 6 and 7 illustrating the tool in an activated configure with the pump piston 92 in a forward stroke position pushing hydraulic fluid into the work engaging cylinder 20 past the work engaging cylinder check valve 126. The activator trigger 18 is now depressed, contacting activator switch 64, activating the electric pump 54 and hence the hydraulic pump, and displacing actuator trigger lobe 66 upwards pressing the multi-function valve casing 142 further into the valve bore 112 lifting the stem collar 150 away from the valve casing collar 144 as the valve disk 148 engages valve seat 114. The multi-function valve 140 stem disk 148 is now biased against valve seat 114 by valve spring 156 thereby isolating the internal cavity of the work engaging cylinder 20 allowing hydraulic fluid pressure and volume to increase in the work engaging cylinder 20. This configuration permits the hydraulic fluid pressure and volume to increase within the work engaging cylinder until the trigger is released or, in the event that the pressure within the work engaging cylinder exceeds a preselected value as defined by the spring constant of valve spring 156, the valve disk 148 is forced from the valve seat 114 thereby providing over pressure relief of the hydraulic fluid by providing a pathway through the various ports in the multi-function valve 140 back to the hydraulic fluid reservoir 38.

Once a work piece has been set, releasing the actuator trigger 18 rotates the trigger lobe 66 away from the bottom of the multi-function valve 140. Hydraulic fluid pressure within the work engaging cylinder 20 from the compression of the nose assembly return spring 130, provides sufficient pressure to lift the valve stem disk 148 away from the valve seat 114 of the multi-function valve 140. As the low hydraulic fluid pressure is not sufficient to compress the multi-function valve spring 156, the valve casing 142 slides outwardly from the valve bore 112 thereby venting hydraulic fluid from the internal cavity of the work engaging cylinder 20, past the valve seat 113, through the valve stem collar ports 152, into the multi-function valve cavity, and through the bottom vent ports 158 back to the hydraulic reservoir 38. Venting the hydraulic fluid back to the reservoir allows the work engaging cylinder 20 to retract back into the tool and away from the work piece.

Similarly, when the tool is at rest, the multi-function valve casing 142 is also retracted incrementally outwardly from the hydraulic piston body 110 lifting the valve disk 148 from the valve seat 114 as the multi-function valve spring 156 presses the valve stem 146 to the top of the valve cylinder with the stem collar 150 retaining the stem within the valve casing. In the rest configuration, hydraulic fluid is free to flow from the work engaging cylinder cavity, past the valve seat 114, through the valve cylinder, through the ports 158 and on to the reservoir 38. Thusly, when the tool is at rest, the work engaging cylinder return spring 130 maintains the work engaging cylinder 20 in the retracted position and the internal cavity is emptied of hydraulic fluid.

A second embodiment of the multi-function valve 160, illustrated in FIG. 8, having the same elements as the first embodiment excepting the valve casing wherein the valve case 162 is absent a top collar thereby removing the upward travel limitation imposed by the collar. In this second embodiment, the valve spring 176 characteristics are selected to provide an unload length commensurate with a maximum upward displacement of the valve stem 166 to allow the valve disk 168 to lift from the valve seat 114 when the tool is at rest. The spring constant is also preselected to allow the valve disk 168 to lift from the valve seat 114 when over pressure conditions occur. As the valve stem 166 is not constrained by the casing, the valve spring further maintains a bias to the actuator trigger lobe providing an assertive mechanical means to return the actuator trigger to the rest position as well as reducing the surface area between the outer circumference of the top portion of the valve casing and the valve bore thereby facilitating retraction of the valve casing from the valve bore in the low hydraulic fluid pressure conditions during venting.

It will be appreciated that various modifications of configuration of the multi-function valve may be utilized to optimize the operation of the multi-function valve whilst providing the same operations and are therefore within the scope of this disclosure.

The embodiments herein provided illustrate adaptation of the tool for rivets and lockbolts; however, it will further be appreciated that other adaptations of the hydraulic piston body and multi-function valve may be made to receive a variety of tool heads.

What is claimed is:

1. An electrically and hydraulically powered rivet and lockbolt setting hand power tool comprising, a hydraulic piston body having front and rear ends, the front end being a hydraulic piston, the rear end being a reciprocating piston pump housing, a work engaging cylinder, having an internal cavity, surrounding and slidably engaging the hydraulic piston of the hydraulic piston body, a reciprocating piston pump being concentrically and longitudinally disposed within the rear end housing of the hydraulic piston body and having a pump piston, having a front portion and having a cam follower flange disposed at the rear of the hydraulic piston body, a hydraulic fluid reservoir, a multi-function valve being in direct hydraulic fluid communication with the work engaging cylinder internal cavity and the hydraulic fluid reservoir having means for pressure relief, isolation of the internal cavity, and venting hydraulic fluid, a cylindrically shaped valve bore formed in the hydraulic piston body, having a diameter, and a multi-function valve seat conically shaped and disposed within the valve bore and in the hydraulic piston body, having direct hydraulic fluid communication between the valve bore and the work engaging cylinder internal cavity through the valve seat and slidably receiving the multi-function valve, a drive cam being perpendicularly positioned adjacent to the rear of the hydraulic piston body and having an offset cam lobe disposed to engage the cam follower flange of the pump piston with the offset cam lobe arranged to reciprocate the pump piston longitudinally respectively and responsively to the rotation of the drive cam; and, an electric motor in mechanical communication with the drive cam wherein the drive cam rotates responsively to the activation of the electric motor.

2. The hand power tool of claim 1 wherein the hydraulic fluid reservoir is disposed around the hydraulic piston body.

3. The hand power tool of claim 1 wherein the reciprocating piston pump further comprising a pump cylinder sleeve being cylindrically shaped and having a cylinder sleeve central bore and at least one pump hydraulic fluid port being in direct hydraulic fluid communication with the hydraulic fluid reservoir and the central bore of the pump cylinder sleeve bore, the pump cylinder sleeve central bore being in direct hydraulic communication with the work engaging cylinder internal cavity, a pump piston, having a pump piston central bore, a circumference, distal and proximate ends and being slidably and centrally disposed within the cylinder sleeve central bore and having at least one pump piston hydraulic fluid port providing direct hydraulic fluid communication between the circumference of the pump piston, through a pump piston central bore to a pump pressure check valve disposed in distal end of the pump piston, a pump forward piston seal disposed forward of the pump piston hydraulic fluid port and between the pump piston circumference and the pump cylinder sleeve central bore, a pump rear piston seal disposed rear of the pump piston hydraulic fluid port and between the pump piston circumference and the pump cylinder sleeve central bore and arranged to be rear of the pump cylinder sleeve hydraulic fluid port during a forward stroke of the pump piston, a work engaging cylinder inlet check valve disposed between the pump cylinder sleeve central bore and the work engaging cylinder internal cavity; and, a pump return spring disposed between the pump cam follower wherein hydraulic fluid is pumped from the hydraulic fluid reservoir to the work engaging cylinder internal cavity.

4. The hand power tool of claim 1 further comprising a planetary gear disposed between the electric motor and the drive cam.

5. The hand power tool of claim 1 wherein the multi-function valve further comprises a top and bottom, a cylindrically shaped valve case having a top, bottom, central bore and an outside diameter, defining the outside of the multi-function valve and being the central valve cylinder, and the valve casing top being a valve casing collar having a central opening, a valve stem centrally disposed within the valve casing comprising a valve disk being the top portion of the valve stem conically shaped conforming with the conical shape of the hydraulic piston body multi-function valve seat and disposed through the top of the valve casing, and a cylindrical shaped stem collar near the top of the valve stem having a top and bottom, and a diameter sufficient to interfere with the valve casing collar wherein the stem collar retains the valve stem within the valve casing, and having at least one hydraulic fluid vent port providing direct hydraulic fluid communication from the top of the multi-function valve to the central bore of the valve casing, a retainer plug received by the bottom of the valve casing, at least one hydraulic fluid bottom vent disposed in the valve casing near the bottom of the valve casing providing direct hydraulic fluid communication between the central bore of the valve casing and the hydraulic fluid reservoir; and a multi-function valve spring disposed between retainer plug and the bottom of the stem collar.

6. The hand power tool of claim 5 wherein the multi-function valve casing outside diameter is selected to provide a close tolerance fit between the hydraulic piston body multi-function valve bore to facilitate a hydraulic fluid seal and slidability within the bore.

7. The hand power tool of claim 5 wherein a user activated trigger lobe contacts the bottom of the retainer plug contacts and arranged to facilitate sliding the multi-function valve into the hydraulic piston body multi-function valve bore when activated.

8. The hand power tool of claim 7 wherein the multi-function valve elements are arranged with the valve disk contacting the hydraulic piston body multi-function valve seat and stem collar separated from the multi-function valve casing collar providing a means for isolation of the work engaging cylinder internal cavity.

9. The hand power tool of claim 7 wherein the multi-function valve elements are arranged with the valve disk contacting the hydraulic piston body multi-function valve seat and the multi-function valve spring compressed and having a spring constant selected for the desired over pressure relief pressure value desired providing a means for pressure relief of the work engaging cylinder internal cavity.

10. The hand power tool of claim 7 wherein the multi-function valve elements are arranged with the valve disk separated from the hydraulic piston body multi-function valve seat and the stem collar contacting the multi-function valve casing providing a means venting hydraulic fluid from the work engaging cylinder internal cavity.

11. The hand power tool of claim 1 wherein the multi-function valve having a top and bottom further comprises, a cylindrically shaped valve case having a top, bottom, central bore and an outside diameter, defining the outside of the multi-function valve and being the central valve cylinder, a valve stem centrally disposed within the valve casing comprising a valve disk being the top portion of the valve stem conically shaped conforming with the conical shape of the hydraulic piston body multi-function valve seat and disposed through the top of the valve casing, and a cylindrical shaped stem collar near the top of the valve stem having a top and bottom, the bottom disposed above the top of the valve casing, and a diameter selected to provide a close tolerance fit between the hydraulic piston body multi-function valve bore facilitating a hydraulic fluid seal and slidability within the bore slide, and having at least one hydraulic fluid vent port providing direct hydraulic fluid communication from the top of the multi-function valve to the central bore of the valve casing, a retainer plug received by the bottom of the valve casing, at least one hydraulic fluid bottom vent disposed in the valve casing near the bottom of the valve casing providing direct hydraulic fluid communication between the central bore of the valve casing and the hydraulic fluid reservoir; and a multi-function valve spring disposed between retainer plug and the bottom of the stem collar.

12. The hand power tool of claim 1 further comprising a battery module being in direct electric communication with the electric motor and an activator switch.

13. The hand power tool of claim 1 further comprising a work piece puller shaft forming the front end of the hydraulic piston body, a work piece stem grip fixed to the work piece puller shaft receiving the stem of a provided work piece, a work engaging cylinder return spring disposed between the work piece stem grip biased to retract the work engaging cylinder towards the hydraulic piston body; and, a nose assembly having an outer cone attached to the work engaging cylinder and a collar contacting the provided faster surrounding material.

14. The hand power tool of claim 1 wherein the hydraulic piston and work engaging cylinder respectively receive a riveter work piece stem grip and nose assembly attachment.

15. The hand power tool of claim 1 wherein the hydraulic piston and work engaging cylinder respectively receive a lockbolt setting work piece stem grip and nose assembly attachment.

* * * * *